US005735326A

United States Patent [19]

Seidner

[11] Patent Number: 5,735,326

[45] Date of Patent: Apr. 7, 1998

[54] SPLIT JAMB FOR A DOOR FRAME OPENING AND METHOD OF MAKING A SPLIT JAMB

[76] Inventor: Marc A. Seidner, 234 Conway Ave., Los Angeles, Calif. 90024

[21] Appl. No.: 819,752

[22] Filed: Mar. 18, 1997

[51] Int. Cl.[6] ..... B27D 1/00

[52] U.S. Cl. ..... 144/350; 83/39; 83/872; 83/875; 144/133.1; 144/136.1; 144/136.3; 144/345; 144/368; 144/375; 52/212

[58] Field of Search ..... 49/505; 52/210, 52/211, 212, 217, 631, 745.16; 83/39, 44, 861, 863, 864, 875, 876, 884; 144/3.1, 136.1, 136.3, 133.1, 137, 201, 203, 204, 345, 350, 368, 375

[56] References Cited

U.S. PATENT DOCUMENTS

| | | | |
|---|---|---|---|
| 1,855,470 | 4/1932 | Bilton | 52/212 |
| 2,736,930 | 3/1956 | Longley | 52/211 |
| 3,735,787 | 5/1973 | Siel | 144/133.1 |
| 3,808,759 | 5/1974 | Carmichael | 52/212 |
| 3,818,960 | 6/1974 | Pozzi | 144/368 |
| 4,012,868 | 3/1977 | Andruszkiewicz | 52/212 |
| 4,112,986 | 9/1978 | Strange et al. | 144/133.1 |
| 5,365,708 | 11/1994 | Winston | 52/212 |
| 5,546,715 | 8/1996 | Edstrom . | |

*Primary Examiner*—W. Donald Bray
*Attorney, Agent, or Firm*—Pretty, Schroeder & Poplawski

[57] ABSTRACT

A method of making a base for a split jamb for a door frame opening, with the base having a groove for receiving the tongue of a slide of a split jamb, including the steps of providing an elongate panel, making a plurality of parallel cuts in the panel, with the cuts not cutting through the panel, the cuts including a plurality of pairs of slots, with the slots of a pair spaced from each other leaving panel material between the slots of each pair, adhering a stop strip over each pair of slots covering the slots of the pair, and gang sawing the panel into jamb base strips by cutting between the slots of each pair of slots to remove the panel material between the slots providing individual jamb base strips. The method wherein the step of making parallel cuts includes making a plurality of notches spaced from each other by the pairs of slots, and wherein the step of gang sawing includes cutting through the panel at each of the notches.

11 Claims, 3 Drawing Sheets

SPLIT JAMB FOR A DOOR FRAME OPENING AND METHOD OF MAKING A SPLIT JAMB

BACKGROUND OF THE INVENTION

This invention relates to jambs for door frame openings and in particular, to a new and improved split jamb construction and method.

In a typical door installation, a frame for the door is positioned around the opening in the wall. One or both vertical sides of the frame will include a protruding stop strip for engaging the door when the door is in the closed position. The stop strip is part of the jamb which is positioned over the exposed edge of the wall.

Walls are of various thicknesses, and hence door jambs must be available in various thicknesses for matching the walls. One conventional way of reducing the number of different jamb sizes which must be provided is to utilize a two piece or split jamb. The split jamb has a first piece or base with a groove therein and a second piece or slide with a protruding tongue. The two pieces are assembled with the tongue in the groove, with the depth of the tongue in the groove being variable to accommodate various wall thicknesses. These two pieces are sometimes referred to in the trade as the female and male pieces.

Split jambs have been produced in various ways. One conventional method is to cut the base from a single strip including milling a rabbet for the stop and milling out the groove for the tongue. This is a relatively expensive process and also results in significant wastage of wood or other material used in forming the base of the jamb. Furthermore, no more than two pieces can be made at one time due to the limitations on milling on conventional moulding machines.

Accordingly, it is an object of the present invention to provide a new and improved base for a split jamb and method of making such a base which will result in significant reduction in material costs and in production time, by enabling numerous bases to be fabricated at a time, typically 20 pieces at a time.

SUMMARY OF THE INVENTION

The method of the invention includes making a base for a split jamb for a door, with the base having a groove for receiving the tongue of a slide of a split jamb, including the steps of providing an elongate panel, making a plurality of parallel cuts in the panel, with the cuts not cutting through the panel, with the cuts including a plurality of pairs of slots, with the slots of a pair spaced from each other leaving panel material between the slots of each pair, adhering a stop strip over each pair of slots covering the slots of the pair, and gang sawing the panel into jamb base strips by cutting between the slots of each pair of slots to remove the panel material between the slots providing individual jamb base strips. The cuts may be with straight sides or with a radius, as desired. Sometimes this type of sawing is referred to as splitting, and the saw is known as a moulder knife head or a splitter knife.

The method may further include making a plurality of notches spaced from each other by the pairs of slots, and cutting through the panel at each of the notches.

The method may also include making auxiliary grooves on each side of the slots of a depth less than that of the slots to define a gap overlying the pair of slots for centrally positioning the stop strips, and adhering a stop strip in the gap.

The method may further include providing second slots in the side of the stop strip adhered to the panel, with the second slots of the width of the slots in the panel.

The invention also includes the base for a split jamb for a door, with the base having a groove for receiving the tongue of a slide of a split jamb, with the base in the form of a strip and consisting essentially of two components, with one of the components having a shoulder with a lower portion of a first width and an upper portion of a second lesser width, and with the second of the components adhered to the first component at the upper portion and overhanging and spaced from the lower portion to define the groove between the second component and the shoulder of the first component.

The invention further includes the elongate panel having a plurality of pairs of slots spaced from each other, with the slots of a depth less than the thickness of the panel, and having a plurality of notches, with a notch between a pair of slots, with the notches of a depth less than the thickness of the panel, and a plurality of stop strips adhered to the panel with a stop strip overlying and enclosing a pair of slots and not overlying a notch.

DESCRIPTION OF THE PREFERRED EMBODIMENTS

Figure 1:
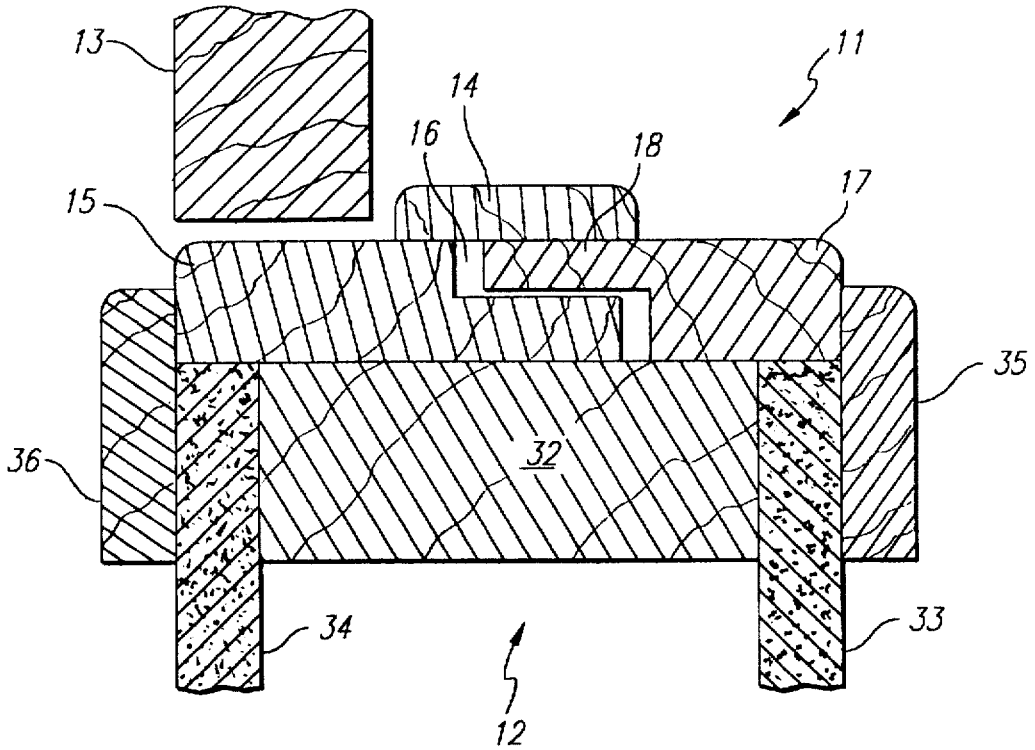
FIG. 1 is a sectional view illustrating the installation of a split jamb incorporating the presently preferred embodiment of the invention, in a doorway opening of a wall with a door in place.

FIG. 1 illustrates a conventional installation of a split jamb 11 on a wall end 12, with a door 13 in the closed position against a stop 14 of the split jamb. A conventional wall end includes a stud 32, wall surfaces 33, 34 and door casings 35, 36.

The split jamb includes a base 15 with a groove 16 and the stop 14. The split jamb also includes a slide 17 with a tongue 18 for positioning in the groove 16 of the base. The base 15 and the slide 17 are separately attached to the stud 32 of the wall end 12, with the ends of the base and slide flush with the wall surface. Thus, it is seen that one split jamb can be used with various wall thicknesses, with the position of the tongue in the groove varying with the thickness of the wall. In the split jamb illustrated in FIG. 1, the stop is formed separate from the base and is adhered to the base to form the groove.

Figure 2:
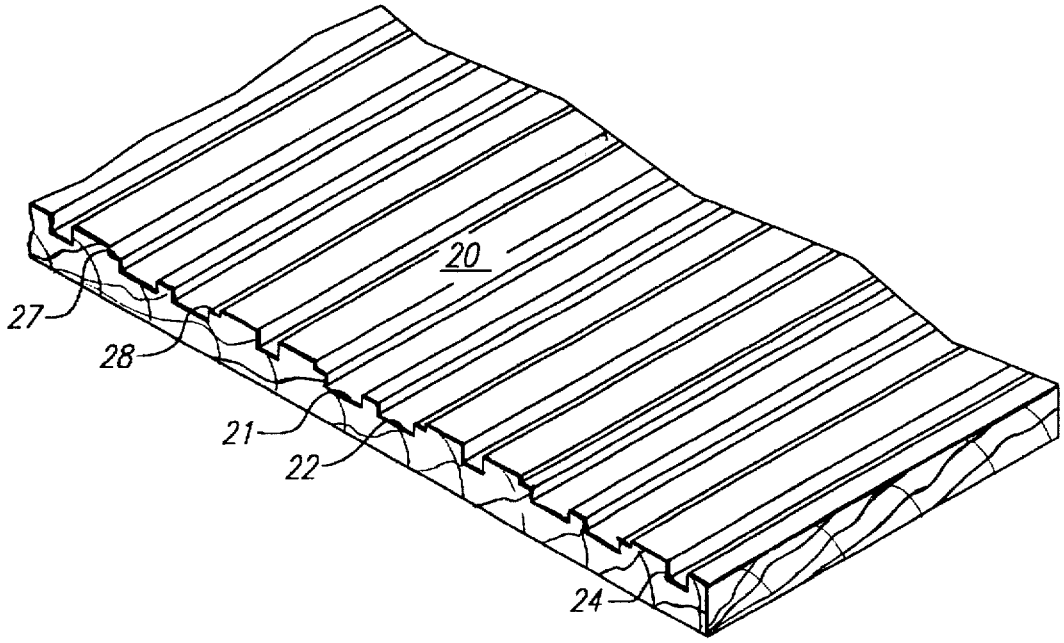
FIG. 2 is a perspective view illustrating a panel with the initial cuts for producing a plurality of the jamb bases.

Referring to FIG. 2, the method for producing the base 15 starts with an elongate panel 20. The panel typically may be four or five feet wide, seven or eight feet long and eleven-sixteenths of an inch thick. A plurality of the base members may be produced simultaneously from a single panel.

Figure 3:
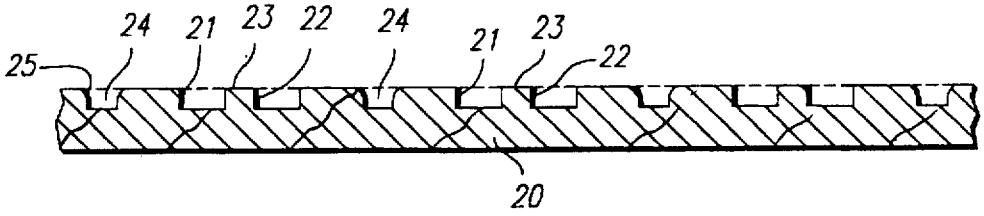
FIG. 3 is an enlarged view of a portion of the panel of FIG. 2.

A plurality of parallel cuts or ploughs are made in the panel, in pairs of slots 21, 22. These slots 21, 22 typically are about three-eighths of an inch deep and about one inch wide. As seen in FIGS. 2 and 3, the slots do not extend through the panel. A strip 23 of panel material remains between the slots of each pair, with this strip being substantially the width of the kerf of the saw blade which will be used in sawing the panel in a later step.

Also, notches or ploughs 24 are cut in the panel at the same time the slots 21, 22 are cut. Typically the notches are the same depth as the slots, and are the width of the kerf of the saw blade to be used in the subsequent sawing step.

Figure 3A:
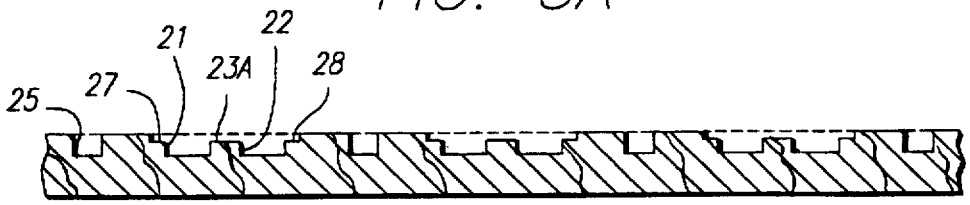
FIG. 3A is a view similar to that of FIG. 3 showing an alternative configuration.

The corners 25 of the notches 24 may be rounded or contoured as shown in FIG. 3 or may be square as shown in FIG. 3A.

In the alternative embodiment shown in FIG. 3A, auxiliary grooves 27, 28 may be cut in the panel on the outer edges of the slots 21, 22 to a lesser depth than the slots 21, 22. There auxiliary grooves provide control of the positioning of the stop strips 29. Also the strip 23 may be cut down the same distance as the grooves 27, 28, as shown at 23A in FIG. 3A. The strip 23 can provide support for the centers of the stop strip.

The various slots, notches and grooves cut in the panel should be carefully located and should be of constant depth. Also the surfaces left in the plans preferably should be smooth. The cuts may be with straight sides or rounded or with other contours, as desired.

Figure 4:
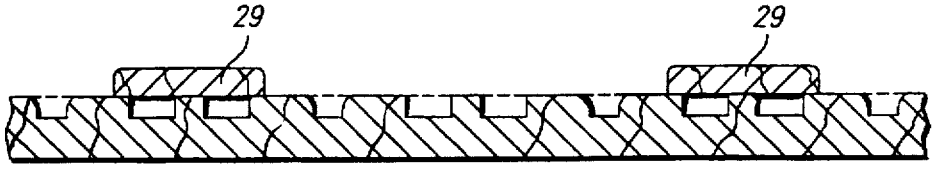
FIG. 4 is a view similar to that of FIG. 3 showing the next step in the production of the jamb base.

The next step in the method is to position a stop strip 29 on the panel overlying each of the pairs of slots 21, 22, as shown in FIG. 4. The stop strips typically are about three-eighths of an inch thick and about two and one-half inches wide, and may be affixed to the panel by an adhesive.

Figure 4A:
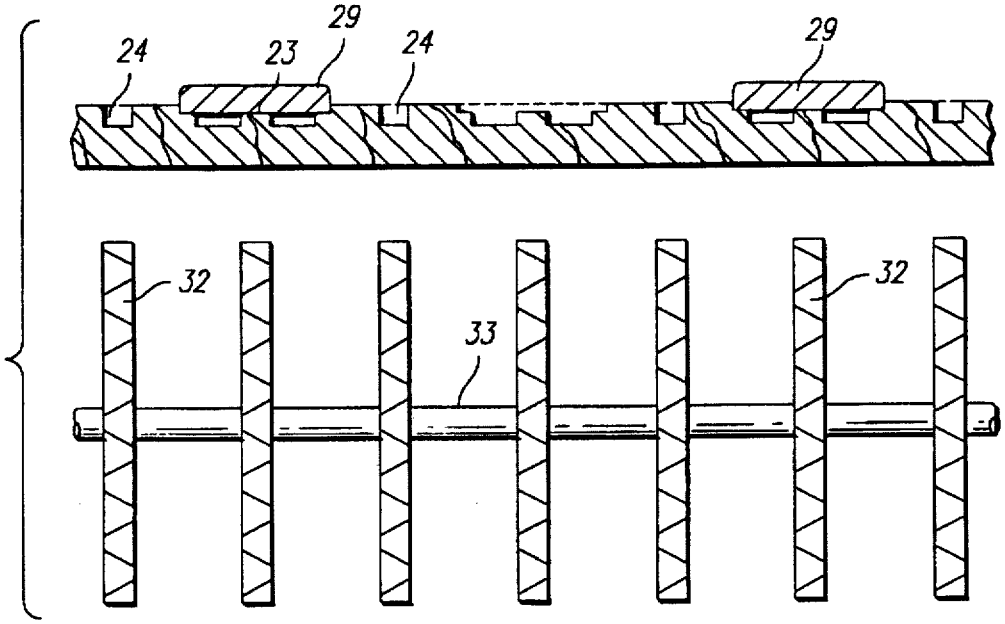
FIG. 4A is a view similar to that of FIG. 4 showing an alternative construction.

When the auxiliary grooves 27, 28 are used as illustrated in FIG. 3A, the stop strips 29 are set in the grooves, overlying the slots 21, 22, as shown in FIG. 4A. The thickness of the stop strips is selected to provide the desired height of the stop 14 of the finished base.

Figure 5:
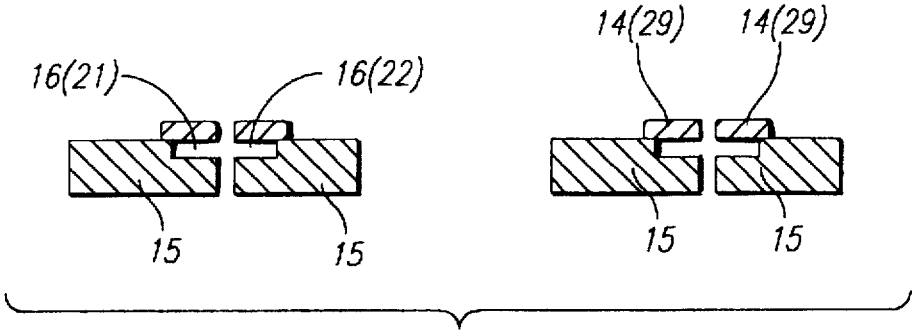
FIG. 5 is a view similar to that of FIG. 4 showing the individual jamb bases after the gang sawing step.

After all the stop strips are secured firmly in place on the panel, the panel is then gang sawed to produce the individual bases 15. The gang saw itself may be typical, and comprises a plurality of saw blades 32 on an arbor 33 with the blades positioned to cut through the panel at the notches 24 and at the strips 23, to produce the strips of the base member 15 as shown in FIG. 5. The sawing operation should remove all of the panel material below each of the notches 24 and all of the panel material at each of the strips 23. With this method, each of the stop strips 29 provides two of the stops 14. Also, the stop strip overlying the slot provides the groove 16 for each base. In the method described above, the jamb base strips are produced in pairs. The same method can be used in producing single jamb strips if desired.

Figure 6A:
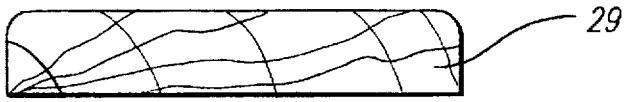
FIG. 6A, 6B and 6C show three alternative configurations for the stop strip.
Figure 6B:
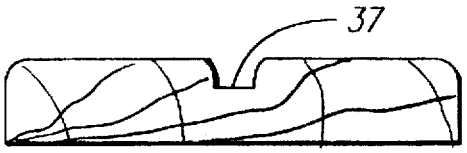
Figure 6C:
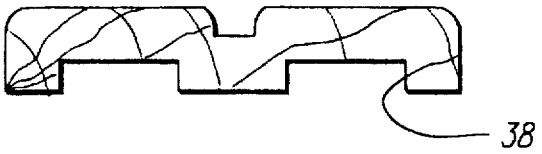

Various configurations for the stop strip are shown in FIGS. 6A, 6B and 6C. The stop strip 29 with rounded or contoured corners is shown in FIG. 6A. If rounded or contoured corners are desired on both corners of the stop 14, a groove 37 may be provided in the stop strip 29, as shown in FIG. 6B. In another alternative configuration, cuts 38 may be provided in the under surface of the stop strip in alignment with the slots 21, 22, as shown in FIG. 6C, to form a portion of the groove 16 of the finished base.

In the most advanced production technique presently used for wood products, only one or at most two side cuts creating the slot 16 on the edge of the base can be made, one on each edge, at a time. Since mouldings are heretofore produced in lineal fashion, production unit volumes have been limited to lineal feed speed of a moulder and a maximum of two pieces at a time. The present invention allows for the production of more than two and, in fact, on a five foot wide panel the production of 20 pieces at a time, substantially reducing cost and increasing output. Base members and stops can be likewise machined in multiples with resulting efficiencies. Furthermore, the present invention allows for the ease of use of an engineered panel such as particle board (medium density fiberboard (MDF), oriental strand board (OSB), or laminated veneer lumber, (LVL), from composite wood allowing for a more consistent quality of product. Panel products usually are lower than solid wood in unit cost for equal volume. This affords the panel user a lower raw material cost per unit. Panels and stops can be prime coated before attachment and gang sawing into discrete jamb components. This permits the production of primed panels in mass and at lower cost of coating rather than in a singular lineal fashion. The attachment of the stop to the base to form the split jamb member also removes the necessity of machining out material to create the rabbet against which the door 13 closes. This saves considerable cost of what is otherwise removed waste wood.

I claim:

1. A method of making a base for a split jamb for a door frame opening, with the base having a groove for receiving the tongue of a slide of a split jamb, including the steps of:

providing an elongate panel;

making a plurality of parallel cuts in the panel, with the cuts not cutting through the panel, said cuts including a plurality of pairs of slots, with the slots of a pair spaced from each other leaving panel material between the slots of each pair;

adhering a stop strip over each pair of slots covering the slots of the pair; and gang sawing the panel into jamb base strips by cutting between the slots of each pair of slots to remove the panel material between the slots providing individual jamb base strips.

2. The method as defined in claim 1 wherein said step of making parallel cuts includes making a plurality of notches spaced from each other by the pairs of slots, and wherein said step of gang sawing includes cutting through the panel at each of the notches.

3. The method as defined in claim 2 including contouring the notches during the notch cutting step.

4. The method as defined in claim 1 wherein the step of making cuts includes making auxiliary grooves on each side of the slots of a depth less than that of the slots to define a gap overlying the pair of slots, and the step of adhering a stop strip includes positioning the stop strip in the gap.

5. The method as defined in claim 4 including the step of providing a channel in the stop strip of a width corresponding to that of the blades of the saw, and including contouring the corners of the channel.

6. The method as defined in claim 5 including the step of providing second slots in the side of the stop strip adhered to the panel, with the second slots of the width of the slots in the panel to provide an increase in width of the groove formed by the overlying stop on the base.

7. A method of making a base for a split jamb for a door frame opening, with the base having a groove for receiving the tongue of a slide of a split jamb, including the steps of:

providing an elongate panel;

making parallel cuts in the panel, with the cuts not cutting through the panel, said cuts including at least one pair of slots spaced from each other leaving panel material between the slots;

adhering a stop strip over the pair of slots covering the slots; and sawing the panel into jamb base strips by cutting between the slots of the pair to remove the panel material between the slots providing individual jamb base strips.

8. The method as defined in claim 7 wherein said step of making parallel cuts includes making notches spaced from each other by the pair of slots, and wherein said step of sawing includes cutting through the panel at each of the notches.

9. A method of making a base for a split jamb for a door frame opening, with the base having a groove for receiving the tongue of a slide of a split jamb, including the steps of:

providing an elongate panel;

making a plurality of parallel cuts in the panel, with the cuts not cutting through the panel, said cuts including slots, with the slots spaced from each other leaving panel material between the slots;

adhering a stop strip over each slot covering the slot; and gang sawing the panel into jamb base strips by cutting between the slots to remove at least a portion of the panel material between the slots providing individual jamb base strips.

10. The method as defined in claim 9 wherein said step of making parallel cuts includes making a plurality of notches spaced from each other by the slots, and wherein said step of gang sawing includes cutting through the panel at each of the notches.

11. An elongate panel having a plurality of pairs of slots spaced from each other, with said slots of a depth less than the thickness of said panel, and having a plurality of notches, with a notch between a pair of slots, with said notches of a depth less than the thickness of said panel, and a plurality of stop strips adhered to said panel with a stop strip overlying and enclosing a pair of slots and not overlying a notch.

* * * * *